US006493628B2

(12) United States Patent
Ando

(10) Patent No.: US 6,493,628 B2
(45) Date of Patent: Dec. 10, 2002

(54) ENGINE CONTROL UNIT HAVING FREQUENCY-MULTIPLIED SIGNAL GENERATING FUNCTION

(75) Inventor: Katsuyuki Ando, Kasugai (JP)

(73) Assignee: DENSO Corporation, Kariya (JP)

( * ) Notice: Subject to any disclaimer, the term of this patent is extended or adjusted under 35 U.S.C. 154(b) by 55 days.

(21) Appl. No.: 09/764,410

(22) Filed: Jan. 19, 2001

(65) Prior Publication Data

US 2001/0032049 A1 Oct. 18, 2001

(30) Foreign Application Priority Data

Jan. 20, 2000 (JP) ..... 2000-011629
Nov. 29, 2000 (JP) ..... 2000-363044

(51) Int. Cl.[7] ..... F02D 41/30; F02P 5/15

(52) U.S. Cl. ..... 701/105; 701/115; 123/406.6; 123/487

(58) Field of Search ..... 701/101, 102, 701/105, 115; 123/406.6, 487

(56) References Cited

U.S. PATENT DOCUMENTS 4,188,820 A * 2/1980 Moser et al. ..... 73/116

FOREIGN PATENT DOCUMENTS

JP 56-77759 * 6/1981 ..... 324/173

* cited by examiner

*Primary Examiner*—Andrew M. Dolinar
(74) *Attorney, Agent, or Firm*—Nixon & Vanderhye P.C.

(57) ABSTRACT

In an engine control unit, a crank signal is generated as a pulse train of every predetermined angle interval corresponding to rotation of a crankshaft of an engine. An edge time measuring counter receives the crank signal and measures an interval of pulses. A frequency multiplication counter generates frequency multiplication clocks of integer times by the next pulse on the basis of a pulse interval of this time. A reference counter counts the number of waves of the frequency multiplication clocks between pulses in the crank signal. When the count value of the reference counter reaches a frequency multiplication number, a guard counter forcedly stops outputting of angle clocks which are outputted in response to generation of frequency multiplication clocks in a tracking counter.

16 Claims, 7 Drawing Sheets

ENGINE CONTROL UNIT HAVING FREQUENCY-MULTIPLIED SIGNAL GENERATING FUNCTION

CROSS REFERENCE TO RELATED APPLICATION

This application is based on and incorporates herein by reference Japanese Patent Applications No. 2000-11629 filed Jan. 20, 2000 and No. 2000-363044 filed Nov. 29, 2000.

BACKGROUND OF THE INVENTION

The present invention relates to an engine control unit, and particularly to an engine control unit which generates frequency-multiplied signal train.

An engine control unit (ECU) is an electronic control unit for performing controls such as fuel injection control, ignition timing control, and idle speed control to operate an engine in an optimum state. Specifically, signals from various sensors for sensing engine operating states such as crank angle sensor and engine coolant temperature sensor are supplied to an the ECU to control an optimum fuel injection amount, injection timing, ignition timing, and the like.

Controls synchronized with the engine speed such as ignition control and injection control, that is, controls synchronized with a crankshaft rotation position are performed by generating a signal of ignition pulses or the like after elapse of offset (delay) time from a predetermined crankshaft position indicated by the edge of a crank signal.

It is, however, necessary to perform an arithmetic operation for converting the angle to time. There is a demand for reduction in processing load and improvement in accuracy.

SUMMARY OF THE INVENTION

It is therefore an object of the present invention to provide an engine control unit with reduced processing load and improved accuracy and, moreover, capable of properly controlling the engine even when a pulse interval in a crank signal becomes long.

According to the present invention, a crank signal is generated as a pulse train of every predetermined angle interval corresponding to rotation of a crankshaft of an engine. An edge time measuring counter receives the crank signal and measures an interval of pulses. A frequency multiplication counter generates frequency multiplication clocks of integer times by the next pulse on the basis of a pulse interval of this time. A reference counter counts the number of waves of the frequency multiplication clocks between pulses in the crank signal. When the count value of the reference counter reaches a frequency multiplication number, a guard counter forcedly stops outputting of angle clocks which are outputted in response to generation of frequency multiplication clocks in a tracking counter.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

The present invention will be described in further detail with reference to an embodiment, which is applied to a four-cylinder four-cycle engine.

Figure 1:
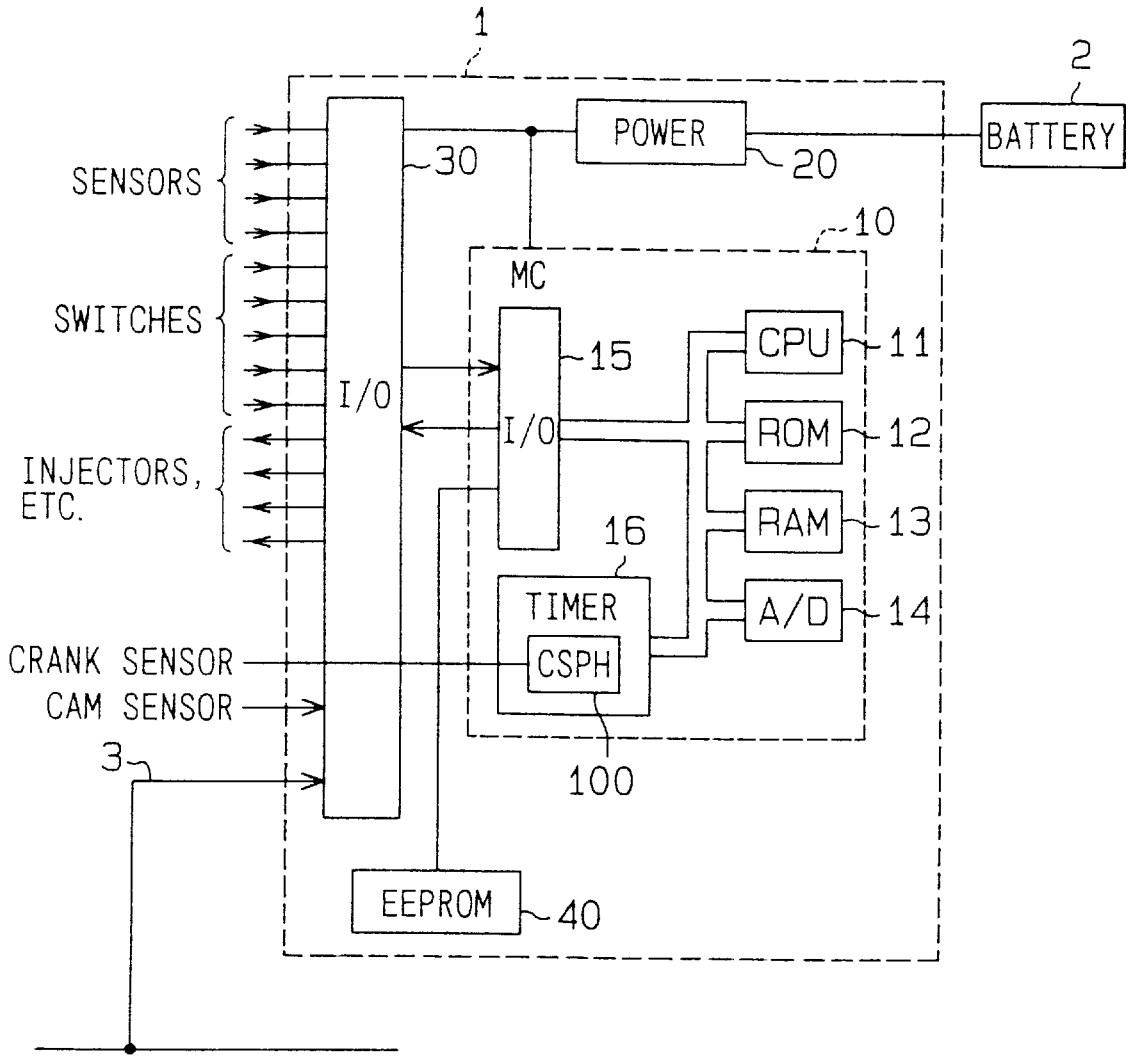
FIG. 1 is a block diagram showing an engine control unit according to an embodiment of the present invention.

Referring to FIG. 1, an engine control unit (ECU) 1 has a microcomputer (MC) 10, a power supply circuit 20, an input/output circuit (I/O) 30, and an EEPROM 40. The power supply circuit 20 receives a supply of power from a battery 2 and supplies a predetermined voltage to various electronic circuit devices in the ECU 1. The microcomputer 10 has a CPU 11, a ROM 12, a RAM 13, an A/D converter 14, an input/output interface 15, and a timer module 16. The circuit devices transmit/receive data to/from each other via a data bus. The EEPROM 40 is connected to the input/output interface 15, and the circuit devices transmit/receive data to/from the EEPROM 40 via the input/output interface 15.

The input/output circuit 30 receives signals from sensors, switches, and the like, and outputs drive signals to an injector (fuel injection valve) and an igniter. Further, a communication line 3 is connected to the input/output circuit 30 and data is transmitted/received to/from other ECU (not shown) via the input/output circuit 30. The CPU 11 in the microcomputer 10 receives signals (data) from the sensors, switches, and the like and data from the communication line 3 via the input/output circuit 30 and the input/output interface 15 and executes various arithmetic operations on the basis of the data to control the injector and the like via the input/output interface 15 and the input/output circuit 30.

The signals received by the ECU 1 include a crankshaft angle position signal (crank signal) from the crank angle sensor and a camshaft angle position signal (cam signal as a cylinder determination signal) from a cam angle sensor. The crank signal may be generated by using a toothed wheel rotated by a crankshaft of the engine, and the cam signal may be generated by using a toothed wheel rotated by a camshaft of the engine which rotates at one-half speed of the crankshaft.

Figure 4:
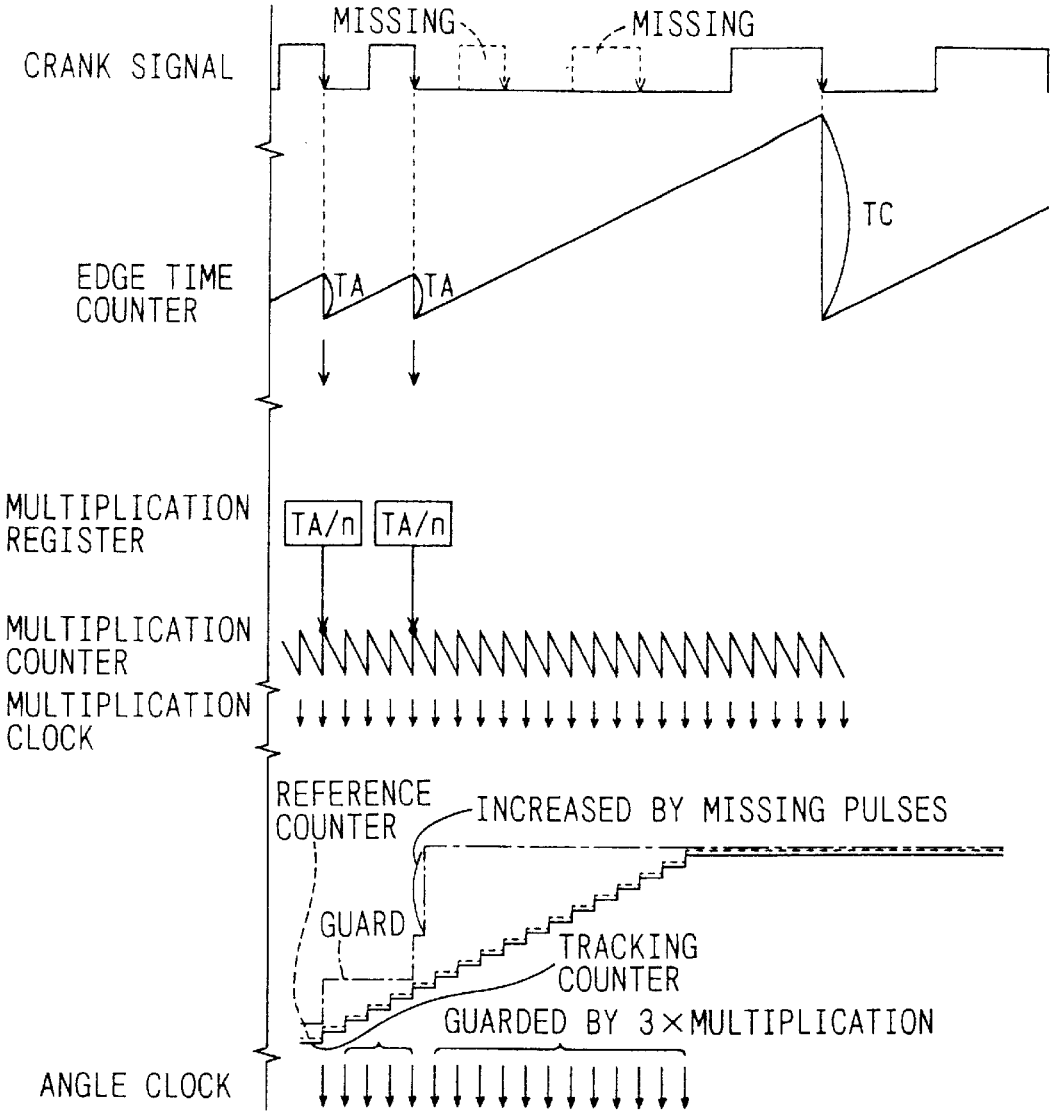
FIG. 4 is a time chart showing the various signals generated in the crank signal processing hardware in the case of missing pulses.

The crank signal is a pulse train of every predetermined angle interval corresponding to rotation of the crankshaft. The crank signal has, as shown in FIG. 4, a pulse missing portion (reference portion) in which pulses are skipped during the pulse train. In the crank signal of the embodiment, two pulses are skipped every 60 pulses (60-2 pulse structure). The pulse missing portion appears twice (every 360° CA) per engine cycle (720° CA). The crank signal is supplied to a crank signal a processing hardware (CSPH) 100 of the timer module 16 in FIG. 1. The pulse missing portion may be provided in the crank signal by eliminating two teeth from the tooth train of the toothed wheel.

Figure 2:
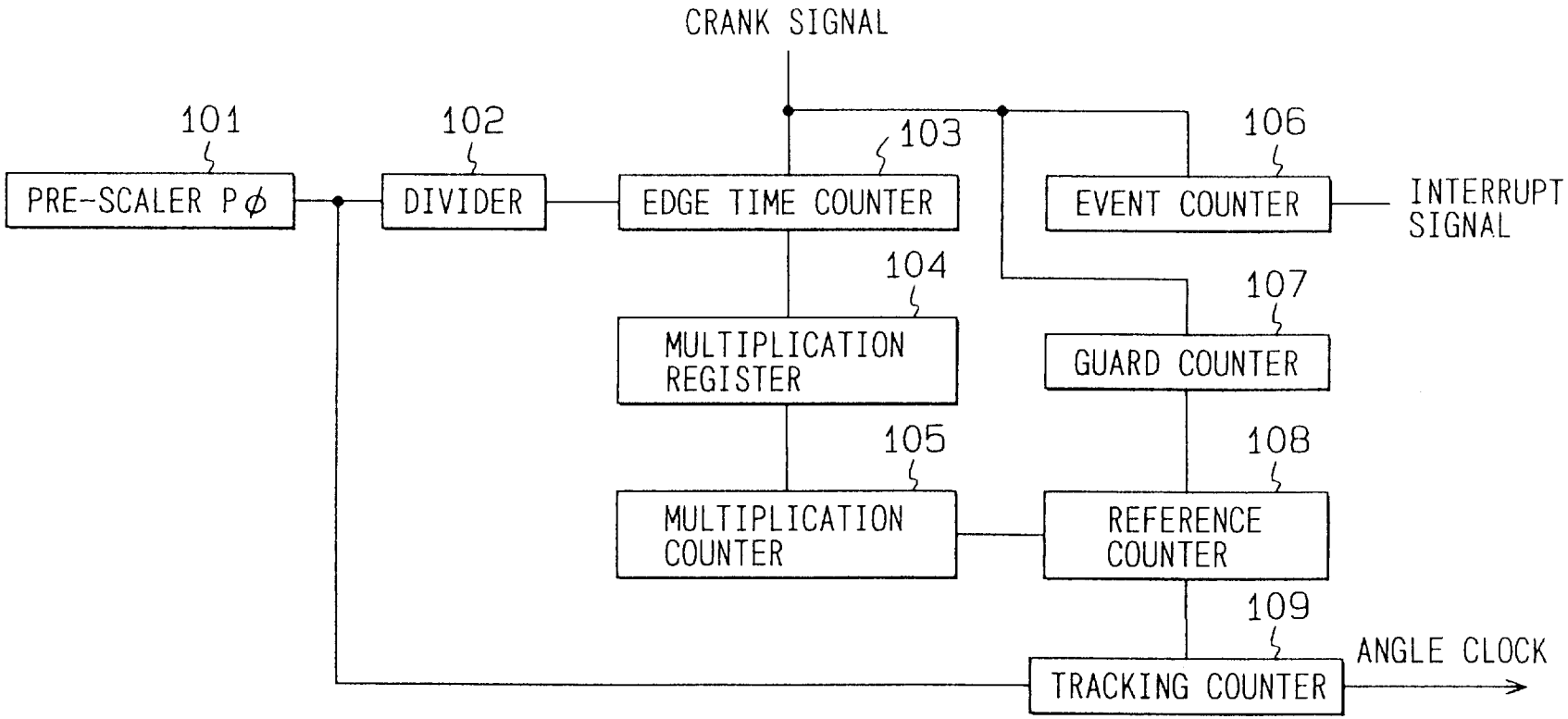
FIG. 2 is a block diagram showing a crank signal processing hardware used in the embodiment.

The crank signal processing hardware 100 provided for the timer module 16 in FIG. 1 is a functional unit for processing the crank signal in a hardware manner. A process on the crank signal (generation of angle signals by dividing crank edge interval) is performed by the crank signal processing hardware 100 in a hardware manner. FIG. 2 shows the configuration of the crank signal processing hardware 100.

In FIG. 2, the crank signal processing hardware 100 has a pre-scaler 101, a frequency divider 102, an edge time measuring counter 103, a frequency multiplication register (edge time storing register) 104, a frequency multiplication counter 105, an event counter 106, a guard counter 107, a reference counter 108, and a tracking counter (angle counter) 109. A signal Pϕ from the pre-scaler 101 is sent to the edge time measuring counter 103 via the frequency divider 102. The signal Pϕ is also sent to the tracking counter (angle counter) 109. Further, the crank signal is sent to the edge time measuring counter 103, event counter 106, and guard counter 107.

In the embodiment, an internal clock (signal Pϕ from the pre-scaler) is set at 20 MHz, and the tracking counter 109 can operate at higher speed as compared with the other counters.

The operation will be described briefly. Time between the trailing edges of pulses in the crank signal is measured by the edge time measuring counter 103, and is divided by (n) by using the frequency multiplication register 104 and the frequency multiplication counter 105, thereby generating frequency multiplication clocks (frequency-multiplied clocks). By using the reference counter 108 and the tracking counter 109, angle clocks according to the generation of the frequency multiplication clocks are outputted. On the basis of the angle clocks, ignition, injection, and the like are controlled synchronously with the crank angles.

The event counter 106 is incremented by the trailing edge of a pulse in the crank signal and outputs an angle cycle interruption signal every trailing edge. The CPU 11 detects the pulse missing portion in the crank signal from the count value (the number of input edges) of the event counter 106. The count value of the event counter 106 is initialized every cycle (720° CA) of the engine.

Figure 3:
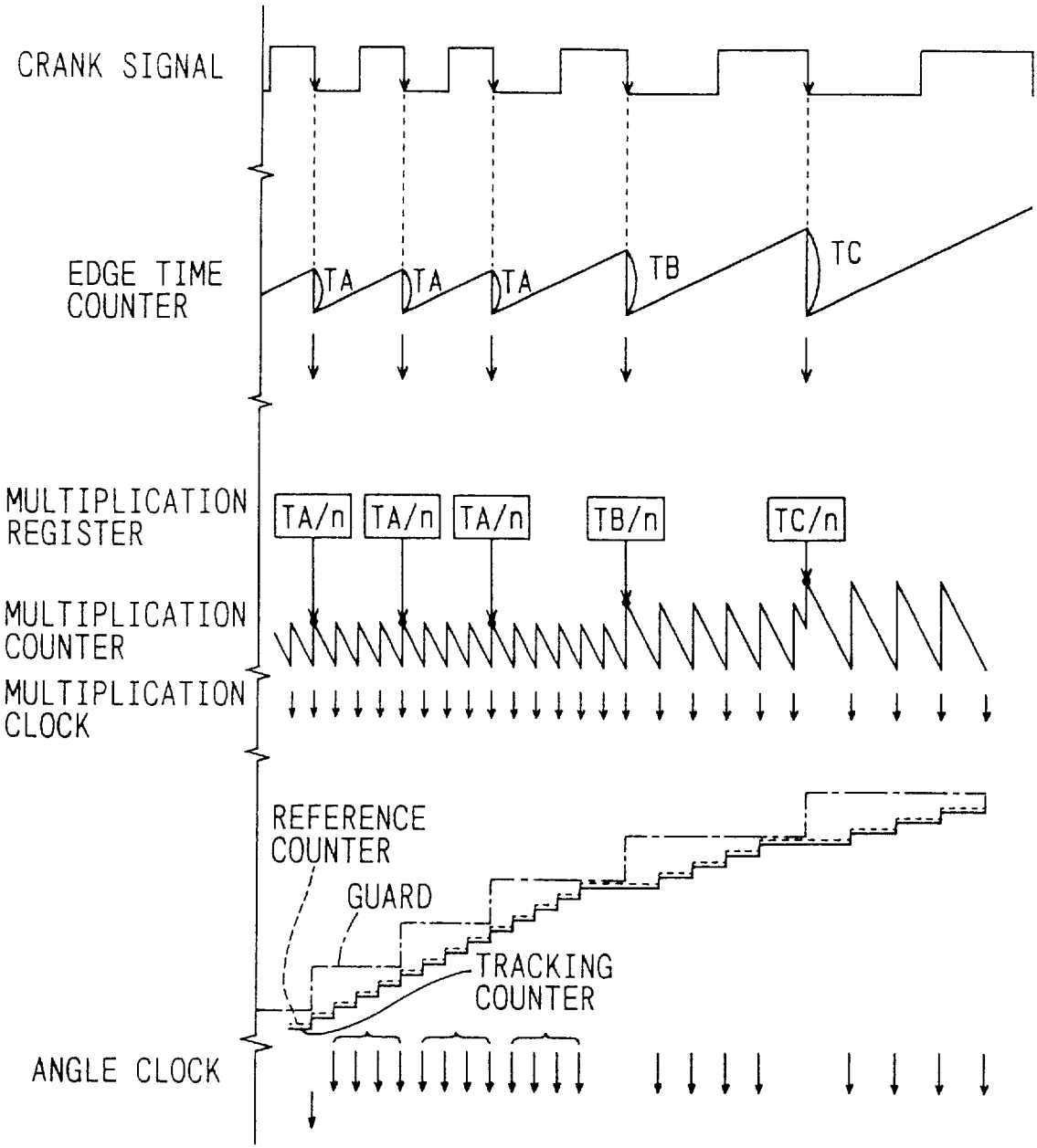
FIG. 3 is a time chart showing various signals generated in the crank signal processing hardware in the case of normal operation.

FIG. 3 is a time chart showing generation of angle clocks (angle signals) in the portion other than the pulse missing portion in the crank signal. Shown in FIG. 3 are the input crank signal, the count value of the edge time measuring counter 103 in FIG. 2, a storage value of the frequency multiplication register 104, a count value of the frequency multiplication counter 105, an output signal (frequency multiplication clock) of the multiplication counter 105, a value which is (n) times as large as the value of the guard counter 107, a count value of the reference counter 108, and a count value of the tracking counter 109.

The edge time measuring counter 103 in FIG. 2 receives the crank signal and measures the time between crank edges (pulse interval). More specifically, the edge time measuring counter 103 as pulse interval measuring means is a counter which is incremented by time synchronization as shown in FIG. 3 and measures time between crank edges (between trailing edges of the crank signal). The measured value is multiplied by 1/n times and resultant data is transferred to the frequency multiplication register 104. The multiplication register 104 functions as time data storing means which holds the time data T/n calculated by dividing the measured pulse interval T by the predetermined number (n). The transferred data T/n serves as an initial value of the frequency multiplication counter 105 as a down-counter. An example of the frequency multiplication value (n) is "32".

The frequency multiplication counter 105 in FIG. 2 generates frequency multiplication clocks by multiplying the crank edge interval measured by the edge time measuring counter 103 by 1/n. Specifically, the frequency multiplication counter 105 counts down by time synchronization as shown in FIG. 3 and, when underflow occurs, generates a frequency multiplication clock, and the count value is reset to the initial value. This operation is repeated. When the next crank edge (trailing edge of the crank signal) is supplied, the value of the frequency multiplication register 104 and the initial value of the frequency multiplication counter 105 are updated to the latest values. The frequency multiplication counter 105 as frequency multiplication signal generating means generates the frequency multiplication signals (frequency multiplication clocks) of integer times by the next pulse on the basis of the pulse interval of this time measured by the edge time measuring counter 103. Thus, the multiplication counter 105 generates the multiplication clock signals in every time interval corresponding to the time data T/n.

The reference counter 108 in FIG. 2 is incremented by the frequency multiplication clock as shown by dotted lines in FIG. 3. The tracking counter 109 in FIG. 2 is incremented by a time synchronization clock (performs a counting operation by the internal clock). The guard counter 107 is a counter for receiving the crank signal and is incremented by the trailing edge of the crank signal. On receipt of a crank edge, a value which is (n) times (frequency multiplication) as large as a value before the increment is transferred to the reference counter 108.

As shown in FIG. 3, the count value of the reference counter 108 cannot exceed the guard value (value of (n) times as large as the count value) transferred from the guard counter 107 when the crank edge is supplied. The guard value is shown by a dotted-chain line in FIG. 3. The tracking counter 109 is incremented only when its value is smaller than the count value of the reference counter 108. Synchronously with the increment of the tracking counter 109, an angle clock (angle signal) is generated. In such a manner, the angle clock is generated by the three counters 107, 108, and 109.

The angle clocks are supplied to a counter (not shown) in the crank signal processing hardware 100, and the ignition and injection control is performed by using a comparison register synchronously with the crank angle. That is, the fuel injection and the ignition are initiated at respective time points defined as delay time or angle from a crankshaft reference position by counting the angle clocks generated by the tracking counter. Thus, by realizing a system which generates frequency multiplication signals (frequency multiplication clocks) at predetermined angle intervals to synchronize with the engine speed, an arithmetic operation for converting from angle to time is made unnecessary. Thus, reduction in processing load and improvement in accuracy (when n=32, LSB=0.1875° CA) can be achieved.

In FIG. 3, at the time of engine deceleration, in the counting operations of the reference counter 108 and the tracking counter 109, the value of the reference counter 108 reaches the value of (n) times as large as the value of the guard counter 107 prior to the input of the crank edge. Thus, the increment of the tracking counter 109 is inhibited. At the time of engine deceleration, therefore, the counting operation of the tracking counter 109 is stopped and generation of more than the predetermined number of angle clocks is disabled.

By enabling the reference counter 108 in FIG. 2 to be incremented only when its value is smaller than the value of (n) times as large as the value of the guard counter 107, the reference counter 108 is guarded at the value of (n) times as large as the value of the guard counter 107, at which the counting operation of the reference counter 108 is stopped. As a result, as shown in FIG. 3, when the time between crank edges of this time is longer than that of last time upon engine deceleration, the increment of the reference counter 108 and the tracking counter 109 is stopped at a frequency multiplication number by the guard counter 107. Thus, generation of the angle clock is stopped. Consequently, the number of clocks generated in the interval between crank edges is always a frequency multiplication number, and the accuracy of controls synchronized with the engine speed is assured.

Figure 7:
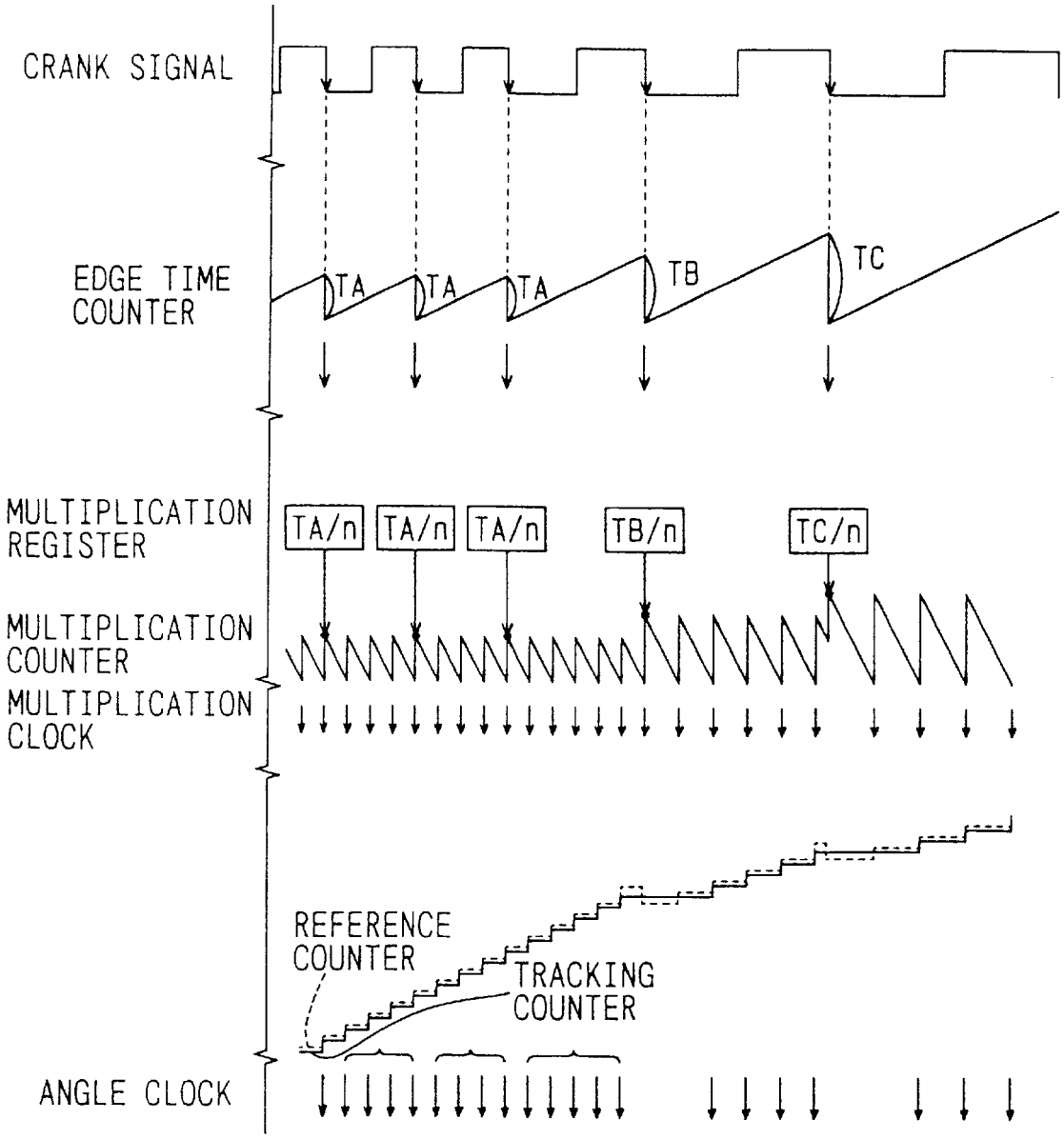
FIG. 7 is a time chart showing the various signals generated in the crank signal processing hardware in the case of engine deceleration.

Specifically, as shown in FIG. 7, when the number of clocks becomes larger than the frequency multiplication number in the interval between pulse edges of the crank signal at the time of engine deceleration, if the number of angle clocks is decreased in the next interval between pulse edges, the number of angle clocks in the interval between pulse edges becomes larger than the frequency multiplication number. Since the angle clock to be inherently generated after the next pulse is supplied is generated before the supply of the next pulse, the controls to be performed synchronously with the engine speed deviates to the more advanced side than it should be, and the controllability is lessened. In contrast, in the embodiment, the number of clocks generated in the interval between crank edges can be always set to a frequency multiplication number, so that the accuracy in ignition and injection can be assured.

Figure 5:
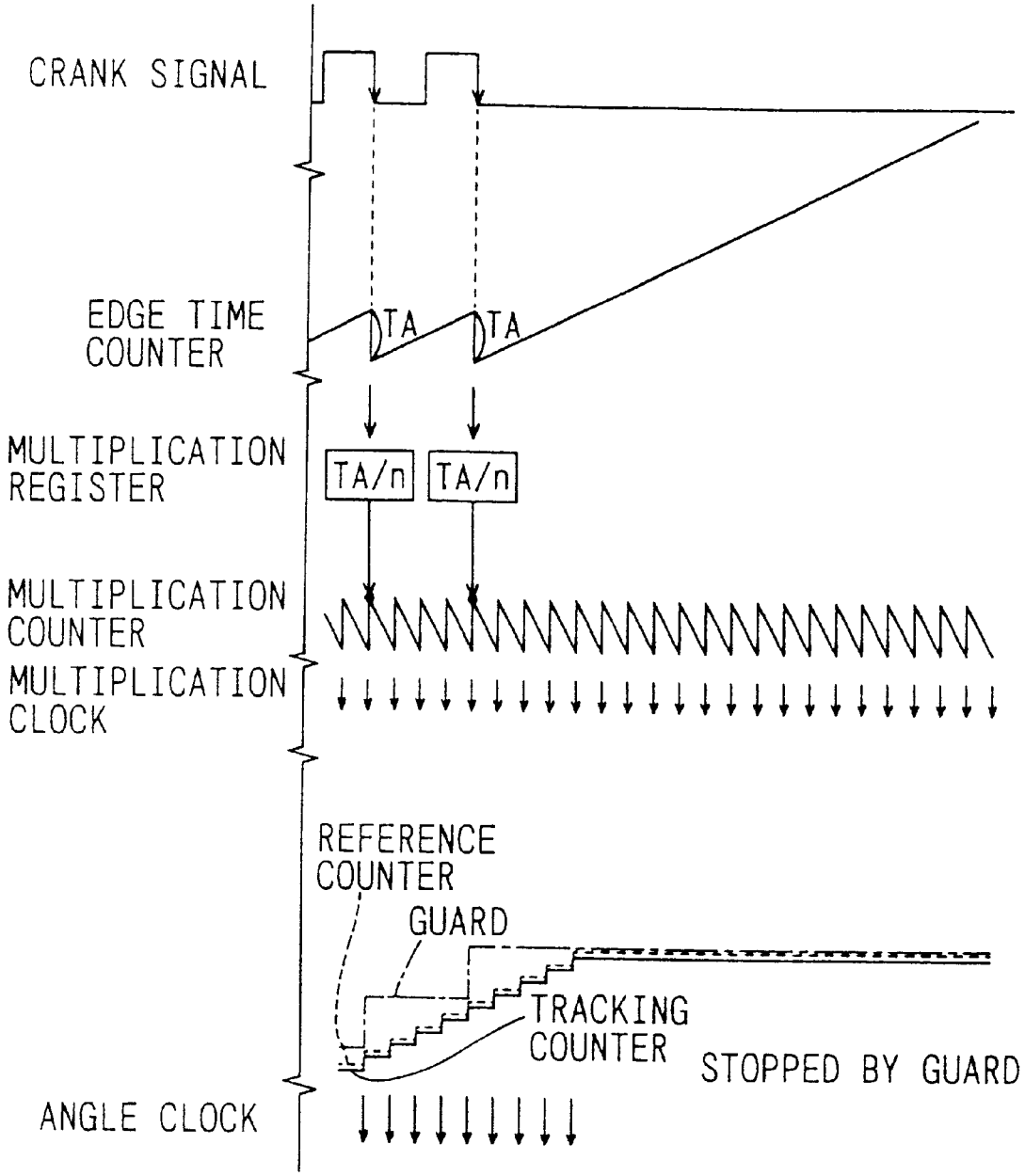
FIG. 5 is a time chart showing the various signals generated in the crank signal processing hardware in the case of no generation of the crank signal under guard operation in the embodiment.

Further, as shown in FIG. 5, even when the transmission of the crank signal (pulse) is stopped due to engine stall or short-circuiting in a crank signal system, the guard function works, thereby stopping the increment and outputting of the angle clock. Consequently, the control of ignition, injection and the like which is continued although the rotation of the crankshaft stops can be inhibited.

Figure 8:
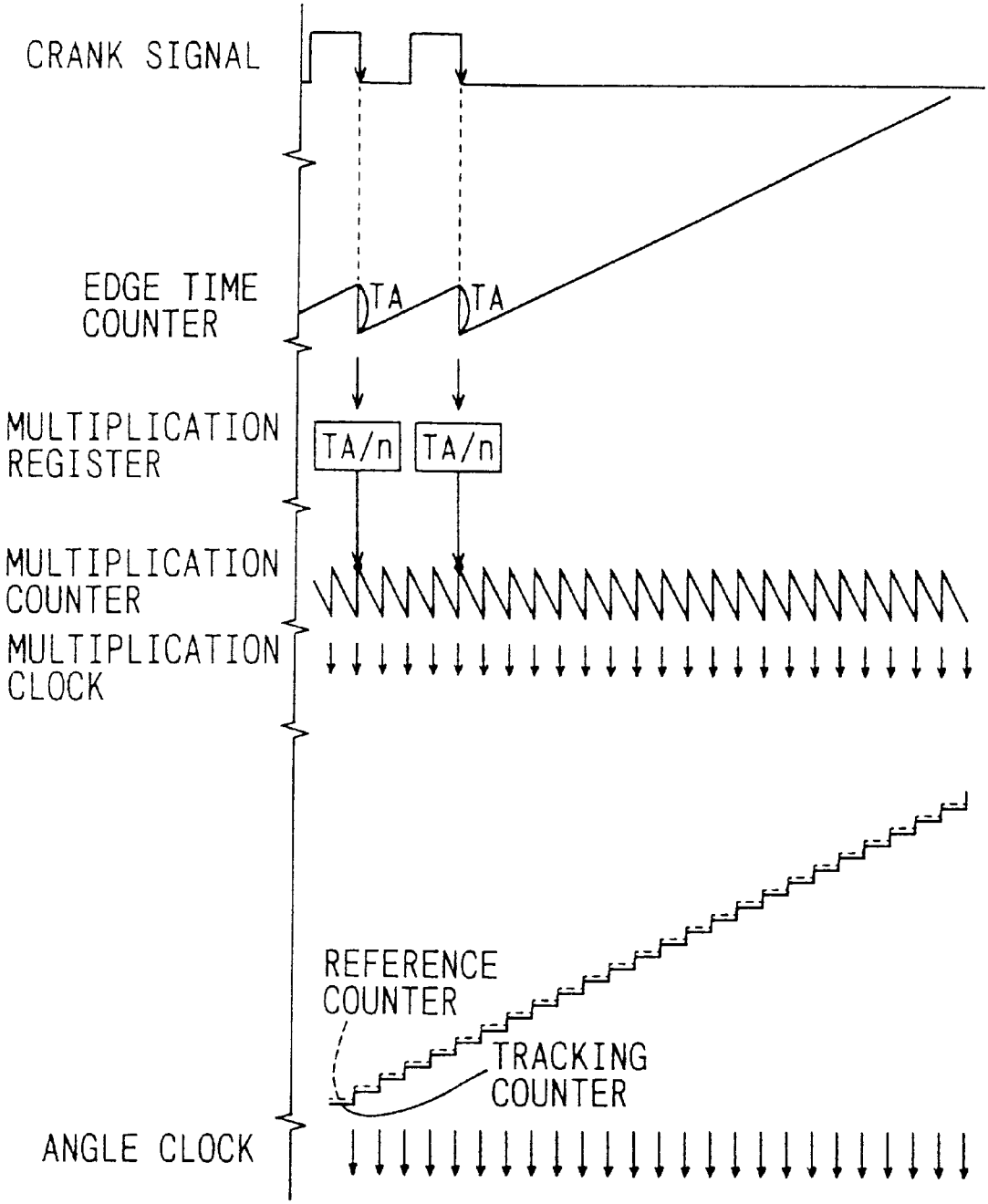
FIG. 8 is a time chart showing the various signals generated in the crank signal processing hardware in the case of no generation of the crank signal under no guard operation of the embodiment.

When the guard function of the embodiment is not provided, the angle clocks are generated until the next pulse is supplied. As shown in FIG. 8, at the time of engine stall or short-circuiting in the crank signal system, even when no crank signal (pulse) is supplied, the angle clock is continuously generated. Consequently, the controls of ignition, injection, and the like are continuously performed even in the case of engine stall. In contrast, according to the embodiment, when the rotation of the crankshaft stops, the controls of ignition, injection, and the like are not performed.

Figure 6:
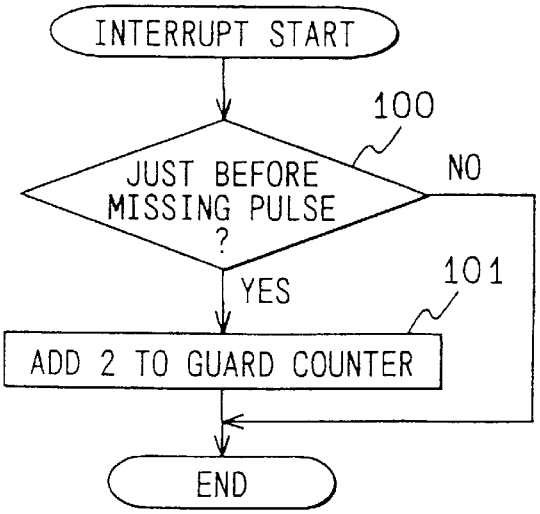
FIG. 6 is a flow chart showing a process of correcting a guard counter used in the embodiment.

The CPU 11 executes processes shown in FIG. 6 to correct the value of the guard counter 107 during the pulse missing period of the crank signal.

At crank edge interruption (by an interrupt signal from the event counter 106 in FIG. 2), at step 100, the CPU 11 determines whether it is just before the pulse missing portion or not from the count value (the number of input edges of the crank signal) of the event counter 106. When it is just before the pulse missing portion, the CPU 11 advances its processing to step 101 and adds "2" to the count value of the guard counter 107. By the operation, as shown in FIG. 4, the value of the guard counter 107 is increased only by the amount of the pulse missing portion. The reference counter 108 and the tracking counter 109 in FIG. 2 therefore perform the counting operation longer by the amount of the pulse missing period, and the angle clocks of the amount of the pulse missing period are generated from the tracking counter 109. Since the angle clocks of the amount corresponding to the number of frequency multiplication×the number of missing pulses are guarded by the guard function, the controls synchronized with the engine speed are not continuously performed even when the engine stroll or short circuiting in the crank signal system occurs during the pulse missing period.

As shown in FIG. 4, when the clocks are guarded by the frequency multiplication number also in the pulse missing period in the system having the pulse missing period in the crank signal, inherently, the angle clocks to be outputted during the pulse missing period are stopped and an accurate control cannot be performed. In the embodiment, however, by raising the count value of the guard counter 107 during the pulse missing period, the angle clocks can be generated also in the pulse missing period in a manner similar to the other period.

The embodiment provides the following features.

(A) The reference counter 108 and the guard counter 107 constructing the guard means count the number of waves of the frequency multiplication signal (frequency multiplication clock) between pulses of the crank signal. When the count number reaches the frequency multiplication number, the output of the angle signal (angle clock) which is outputted according to the generation of the frequency multiplication signal (frequency multiplication clock) is forcedly stopped. That is, when the angle clock reaches the frequency multiplication number, the reference counter 108 is guarded at the frequency multiplication value until the next pulse is supplied.

When the number of waves of the frequency multiplication signal (the number of angle clocks) reaches the frequency multiplication number, the counting operation of the tracking counter 109 is stopped until the pulse of the next crank signal is inputted to guard the output of the angle clocks of the frequency multiplication value. Consequently, at the time of sudden engine deceleration, the angle signal (angle clock) to be generated after the next pulse of the crank signal is supplied can be prevented from being generated before the pulse is supplied. The output of the angle clocks can be stopped at the time of engine stroll or short-circuiting in the crank signal system. In a system which generates the frequency multiplication signal at predetermined angle intervals and operates synchronously with engine speed, even when the pulse interval of the crank signal becomes long, the engine control can be properly performed.

(B) The guard counter 107 as guard data generating means counts the crank signals and generates guard data by multiplying the crank signal count data by the number (n). The reference counter 108 as the reference data generating means receives the multiplication clock signal and the guard data, and executes its counting operation in synchronism with the multiplication clock signals to generate the reference count data while using the guard data as its upper limit. The tracking counter 109 as the control clock generating means generates the control clocks (angle clocks) based on the reference count data. Thus, by generating the control clock signals while limiting it to the guard data as the upper limit, it is prevented at the time of sudden engine deceleration that the control clock signal, which should appear after the pulse following the crank signal, appears before the input of the pulse. Further, generation of the control clocks is disabled when the engine stalls or crank signal line is disconnected.

(C) The crank signal has the pulse missing portion in the pulse train of every predetermined angle interval. The CPU 11 as guard value correcting means executes the processes of FIG. 6 to increase the guard value of the guard counter 107 only by an amount corresponding to the missing pulses in the pulse missing portion of the crank signal. That is, the guard value is corrected to a value which is a multiplication of the number of the missing pulses. Specifically, 2 is added to the guard counter value at step 101 in FIG. 6, and the resultant value which is n-times of the resultant count (count+2) is sent to the reference counter 108. In this a manner, by increasing the guard value of the guard counter 107 by the amount of the missing pulses so as to be corrected, the guard function can be accurately performed, and the proper number of angle signals (angle clocks) can be outputted also in the pulse missing period.

Although the reference position in the crank signal is the pulse missing portion in the pulse train in the above description, it is not limited to the pulse missing portion. A reference position in which a pulse interval is not uniform may be provided in a pulse train of every predetermined angle interval in another structure (such as a structure in which a pulse is inserted in a pulse train). By correcting the guard value of the guard counter 107 in the reference position in the crank signal, the guard function is accurately performed and the proper number of angle signals can be outputted also in the reference position.

Further, the present invention should not be limited to the disclosed embodiment, but may be implemented in other ways without departing from the spirit of the invention.

What is claimed is:

1. An engine control unit comprising:

pulse interval measuring means for receiving a crank signal of a pulse train of every predetermined angle interval corresponding to rotation of a crankshaft of an engine and measuring a pulse interval;

frequency multiplication signal generating means for generating frequency multiplication signals of integer times until a next pulse on the basis of a pulse interval of this time measured by the pulse interval measuring means; and guard means for forcedly stopping outputting of an angle signal which is outputted in response to generation of a frequency multiplication signal, when the number of waves of the frequency multiplication signal is counted between pulses of the crank signal by the frequency multiplication signal generating means and reaches a frequency multiplication number.

2. The engine control unit as in claim 1, wherein:

the crank signal has a reference position in which the pulse interval is irregular in the pulse train of the every predetermined angle interval; and guard value correcting means is provided for correcting a guard value of the guard means in the reference position of the crank signal.

3. The engine control unit as in claim 2, wherein:

the reference position in the crank signal is a pulse missing portion in the pulse train of the every predetermined angle interval; and the guard value correcting means increases the guard value only by an amount of the missing pulses in the pulse missing portion in the crank signal.

4. An engine control unit comprising:

pulse interval measuring means for receiving a crank signal of a pulse train of every predetermined angle interval corresponding to rotation of a crankshaft of an engine and measuring a pulse interval;

time data holding means for holding a time data which is calculated by dividing the pulse interval by a predetermined number;

frequency multiplication clock generating means for generating frequency multiplication clock signals in each time interval corresponding to the time data;

guard data generating means for executing a count operation in synchronism with the crank signal and generating a guard data which is calculated by multiplying a crank signal count data by a predetermined number;

reference data generating means for receiving the multiplication clock signal and the guard data and executing a count operation in synchronism with the multiplication clock signal, while limiting its count by the guard data as an upper limit, thereby to generate a reference count data; and control clock generating means for generating control clock signals based on the reference count data.

5. The engine control unit as in claim 4, wherein:

the crank signal has a reference position in which the pulse interval is irregular in the pulse train; and guard data correcting means is provided for correcting the guard data of the guard data generating means in the reference position of the crank signal.

6. The engine control unit as in claim 5, wherein:

the reference position in the crank signal is a pulse missing portion in the pulse train; and the guard data correcting means corrects the guard data in the pulse missing portion to a value which is calculated by a multiplication of the number of missing pulses.

7. The engine control unit as in claim 4, further comprising:

fuel injection control means for controlling a time point of fuel injection of the engine by using the control clock signals.

8. The engine control unit as in claim 4 further comprising:

ignition control means for controlling a time point of ignition of the engine by using the control clock signals.

9. A method of controlling an engine, the method comprising:

receiving a crank signal of a pulse train of every predetermined angle interval corresponding to a rotation of a crankshaft of an engine and measuring a pulse interval;

generating frequency multiplication signals of integer times until a next pulse on the basis of a pulse interval of this time that has been measured; and forceably stopping outputting of an angle signal which is outputted in response to generation of a frequency multiplication signal, when the number of waves of the frequency multiplication signal is counted between pulses of the crank signal and reaches a frequency multiplication number.

10. The method in claim 9, wherein:

the crank signal has a reference position in which the pulse interval is irregular in the pulse train of the every predetermined angle interval; and further comprising correcting a guard value in the reference position of the crank signal.

11. The method as in claim 10, wherein:

the reference position in the crank signal is a pulse missing portion in the pulse train of the every predetermined angle interval; and the guard value is increased only by an amount of the missing pulses in the pulse missing portion in the crank signal.

12. A method of controlling an engine, the method comprising:

receiving a crank signal of a pulse train of every predetermined angle interval corresponding to rotation of a crankshaft of an engine and measuring a pulse interval;

holding a time data which is calculated by dividing the pulse interval by a predetermined number;

generating frequency multiplication clock signals in each time interval corresponding to the time data;

executing a count operation in synchronism with the crank signal and generating a guard data which is calculated by multiplying a crank signal count data by a predetermined number;

receiving the multiplication clock signal and the guard data and executing a count operation in synchronism with the multiplication clock signal, while limiting its count by the guard data as an upper limit, thereby to generate a reference count data; and generating control clock signals based on the reference count data.

13. The method as in claim 12, wherein:

the crank signal has a reference position in which the pulse interval is irregular in the pulse train; and further comprising correcting the guard data in the reference position of the crank signal.

14. The method in claim 13, wherein:

the reference position in the crank signal is a pulse missing portion in the pulse train; and the guard data is corrected in the pulse missing portion to a value which is calculated by a multiplication of the number of missing pulses.

15. The method as in claim 12, further comprising:

controlling a time point of fuel injection of the engine by using the control clock signals.

16. The method in claim 12 further comprising:

controlling a time point of ignition of the engine by using the control clock signals.

* * * * *